US005964444A

United States Patent [19]

Guertler

[11] Patent Number: 5,964,444

[45] Date of Patent: Oct. 12, 1999

[54] TRAFFIC LIGHT ASSEMBLY

[76] Inventor: James J. Guertler, 104 Saddle Brook Dr., Oakbrook, Ill. 60521

[21] Appl. No.: 08/962,079

[22] Filed: Oct. 31, 1997

[51] Int. Cl.[6] ..... F21S 1/10

[52] U.S. Cl. ..... 248/548; 248/218.4; 248/219.2; 362/431

[58] Field of Search ..... 248/548, 549, 248/218.4, 219.2, 900; 362/431; 403/97, 359

[56] References Cited

U.S. PATENT DOCUMENTS

| | | | |
|---|---|---|---|
| 372,334 | 11/1887 | Sawyer | 362/431 |
| 3,127,870 | 4/1964 | Bieber . | |
| 3,521,413 | 7/1970 | Scott et al. . | |
| 4,302,799 | 11/1981 | Behrens . | |
| 4,489,910 | 12/1984 | Ferguson . | |
| 4,617,768 | 10/1986 | Gebelius | 362/431 X |
| 4,630,413 | 12/1986 | Svensson . | |
| 4,662,775 | 5/1987 | Faul | 403/359 X |
| 4,729,073 | 3/1988 | Klaus . | |
| 4,778,265 | 10/1988 | Fingerle et al. . | |
| 4,819,402 | 4/1989 | Schneider | 403/359 X |
| 4,878,160 | 10/1989 | Reneau et al. | 362/431 X |
| 5,088,683 | 2/1992 | Briden . | |
| 5,105,350 | 4/1992 | Tolman et al. | 362/431 |
| 5,160,111 | 11/1992 | Hugron . | |
| 5,214,886 | 6/1993 | Hugron . | |
| 5,326,186 | 7/1994 | Nyberg | 403/359 X |
| 5,330,149 | 7/1994 | Haan et al. . | |
| 5,377,949 | 1/1995 | Haan et al. . | |
| 5,480,121 | 1/1996 | Rice et al. . | |
| 5,484,217 | 1/1996 | Carroll et al. . | |
| 5,601,274 | 2/1997 | Minor et al. | 362/431 X |
| 5,645,255 | 7/1997 | Parduhn | 403/97 X |

*Primary Examiner*—Derek J. Berger
*Attorney, Agent, or Firm*—Mathew R. P. Perrone, Jr.

[57] ABSTRACT

The traffic light assembly includes a mounting pole, and two arms attached to the pole by straps and a breakaway cap, thereby securing a traffic light housing to the mounting pole. The breakaway cap secures the traffic light housing to the arms and provides for the breakaway function.

9 Claims, 4 Drawing Sheets

TRAFFIC LIGHT ASSEMBLY

This invention relates to a traffic light housing and more particularly to a traffic light housing mounted in a traffic light assembly with a breakaway cap that is used in combination with supporting arms, which arms, in turn, secure the traffic light housing to the post and permit the breakaway cap to function.

BACKGROUND OF THE INVENTION

A traffic light is an important feature in traffic control today. Preferably, a traffic light is mounted adjacent to an intersection. With the amount of traffic passing through an intersection, it is not unusual for a traffic light to be struck by a vehicle.

When the traffic light is struck by a vehicle, it requires a great deal of work to replace the traffic light and get the traffic light back in operation and functioning, without the possibility of the whole intersection being disrupted. Such an accident can tie up the intersection for a substantial period of time and lead to dangers for the other traffic passing around and through the intersection, without traffic light control. Although it is a given feature that the traffic light may be struck, it is desired to minimize the damage caused by the striking.

If the traffic light itself can breakaway without suffering substantial damage to the mounting post, great advantages are obtained. There is a much more simple solution to remount the traffic light on the mounting post, than it is to reestablish the mounting post. In this fashion, the quicker the traffic light is remounted and reactivated, the better the situation is. If the traffic light can be designed so that the traffic light can be strong and supported while at the same time yielding to a blow without damaging the mounting post, the great advantage are obtained.

Positioning of the light assembly at the intersection is also very important. The traffic light assembly must be visible. Yet such traffic light assemblies must provide a clearance for traffic at the intersection. Clearance at the intersection and visibility of the traffic light assembly have contrary functions. One factor cannot usually be maximized without minimizing the other factor. If both visibility and clearance of the traffic light housing in the traffic assembly can be maximized, great advantages can be realized.

SUMMARY OF THE INVENTION

Among the many objectives of this invention is to provide a breakaway traffic light assembly, with maximum strength, and maximum clearance and visibility of the traffic light assembly, while minimizing damage to a mounting pole, if a traffic light housing is struck.

Another objective of this invention is to provide a mounting cap for a traffic light housing.

Yet another objective of this invention is to provide a breakaway cap to receive an arm to support a traffic light housing.

Still another objective of this invention is to provide a mounting cap for a traffic light housing capable of minimizing damage to a mounting pole when a traffic light housing is struck.

Additionally, an objective of this invention is to provide a traffic light assembly, which may simply repaired.

Also an objective of this invention is to provide a traffic light housing with maximum visibility.

A further objective of this invention is to provide a traffic light assembly, which can maintain signal function at an intersection when a traffic light housing is struck.

A still further objective of this invention is to provide a breakaway cap to which support continued safety features for the traffic light assembly.

Yet a further objective of this invention is to provide a breakaway cap to which provides strength to a traffic light assembly.

Another objective of this invention is to provide a mounting cap for a traffic light housing to minimize damage to a mounting pole, if a traffic light housing is struck.

Yet another objective of this invention is to provide a breakaway cap to provide greater visibility for a traffic light housing.

Still another objective of this invention is to provide a breakaway cap to provide greater clearance of the traffic light housing by the traffic.

These other objectives and other objectives of the invention (which other objectives become clear upon a person's consideration of the specification, claims and drawings as a whole) are met by providing a breakaway cap for use in a traffic light assembly. The traffic light assembly includes a mounting pole, and two arms attached to the pole by straps and the breakaway cap, thereby securing a traffic light housing to the mounting pole.

BRIEF DESCRIPTION OF DRAWINGS

Throughout the figures of the drawings where the same part appears in more than one figure the same number is applied thereto.

DESCRIPTION OF THE PREFERRED EMBODIMENTS

Figure 1:
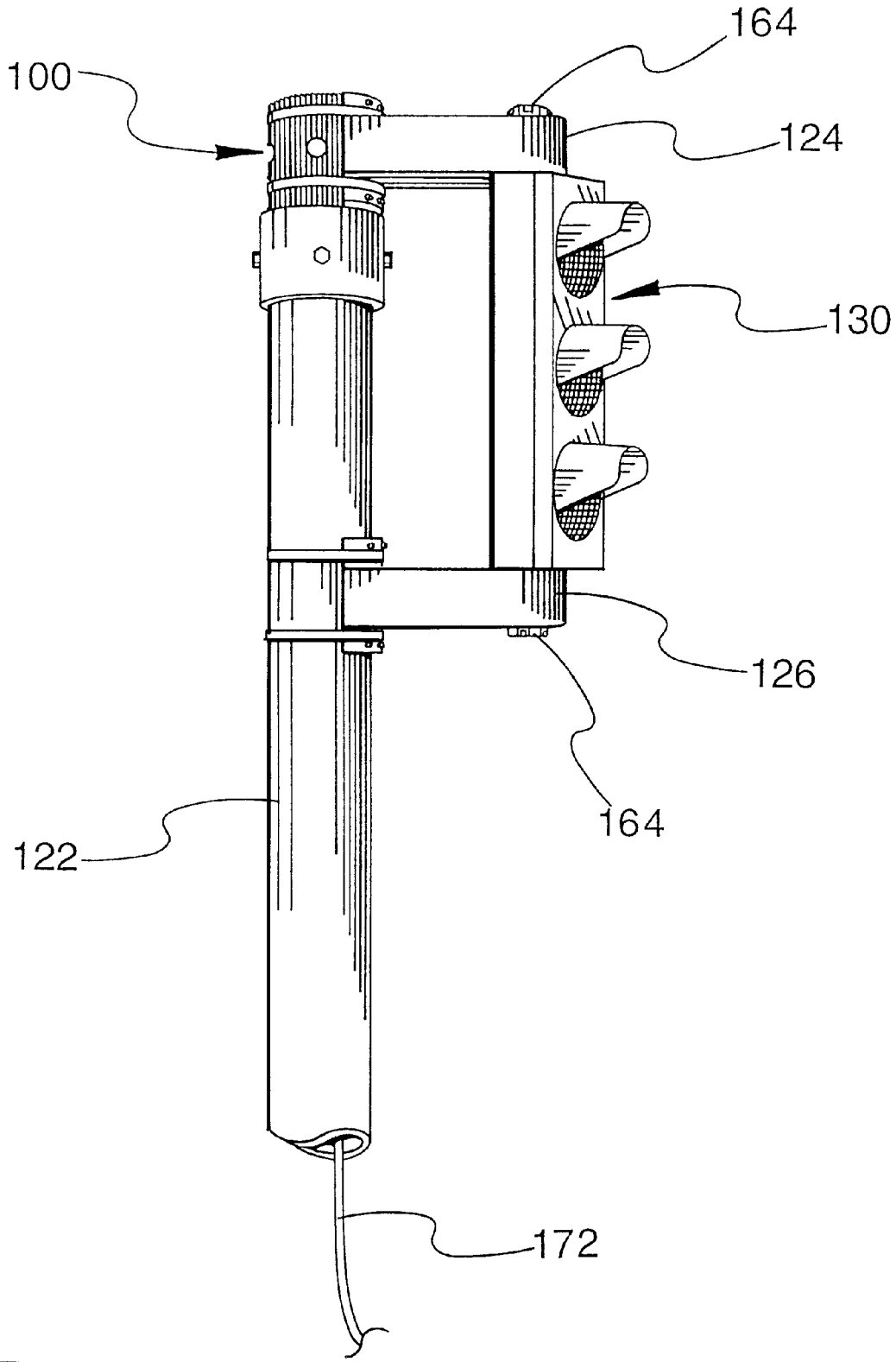
FIG. 1 depicts a perspective view of traffic light assembly 120 using a breakaway mounting cap 100.

The traffic light assembly of this invention includes a breakaway or a mounting cap, which assists in attaching a traffic light housing onto the mounting pole. An upper arm and a lower arm attach the traffic light housing to the mounting pole in combination with the breakaway cap.

More particularly the breakaway cap slides onto the top of mounting pole. Two straps secure both the upper arm and the lower arm in position. The upper arm is secured to the mounting cap. The lower arm is secured to the mounting pole. Preferably, there is an upper mounting strap and a lower mounting strap for each of the upper arm and the lower arm.

The upper arm and the lower arm each have a mounting flange with an upper protrusion and a lower protrusion extending therefrom. The lower protrusion is received in the lower strap, as lower strap is wrapped around the mounting pole or breakaway cap. The upper protrusion is received in the upper strap, as the upper strap is wrapped around the mounting pole for the lower arm, and around the breakaway cap for upper arm.

A preferred material for the lower arm, the breakaway cap and the upper arm is high impact plastic. Typical of these plastics is polycarbonate, polyethylene, polypropylene, combinations thereof, and combinations thereof with other components; so long as the high impact strength and breakaway capabilities are achieved. Since these materials are non-conductive, breaking thereof will not short circuit the entire intersection.

At the end of the protrusion opposite the mounting flange is an upper housing aperture in the upper arm adapted to receive the top cap of the traffic light assembly. Likewise, at the end of the protrusion opposite the mounting flange is a lower housing aperture in the lower arm adapted to receive the bottom cap of the traffic light assembly.

The top cap and the bottom cap of the traffic light housing may each receive wires to operate the lights contained therein. An appropriate wire bushing and power command cord can than be received by the light housing with minimal problem. The arms support the traffic light housing. Wire caps close both the aperture in the upper arm and the aperture in the lower arm, thereby protecting the wiring for the traffic light housing in the traffic light assembly.

With the breakaway cap on the top of the mounting pole, the traffic light housing is attached as part of the traffic light assembly efficiently and strongly and flexibly to the mounting pole. Breakaway cap permits a variety of strong positions for traffic assembly, providing at the same maximum visibility and maximum clearance. Breakaway cap permits a separation of the traffic light housing from the mounting pole when the housing is struck. The plastic nature of the breakaway cap, and the upper and lower arms prevent electric short circuits of the other intersection light functions.

If the traffic light housing is ever struck, for example by a vehicle, no damage is done to the mounting post of the traffic light assembly, because the cap permits the traffic light assembly to breakaway from the post. When this break occurs, it happens without severe damage to the post, and with minimal damage to the arms and the mounting pole. All that usually has to be replaced is the breakaway cap.

The breakaway cap includes a larger cylindrical section and a smaller cylindrical section, as determined by the diameter of the cylinder. The smaller upper cylinder has upper apertures therein. These upper apertures are usable for a wide variety of purposes. They may provide wiring access, add to the breakaway function of the cap or assist in the securing the upper arm to the mounting pole. An upper strap and a lower strap preferably combine to secure the upper arm to the upper cylinder.

On the outer wall of the upper cylinder are a series serrations or ridges surrounding the outer wall. These serration permit a variety of strong positions for the upper arm, and thence a strong position for both the upper arm and the traffic light housing.

Also in the upper cylinder are four (4) equally spaced apertures, an efficient mounting can be obtained for the arms while achieving the breakaway capabilities. The lower base mounts around the top of the mounting post of the traffic light assembly. Lower base apertures permit securing the breakaway cap to the mounting pole. In this fashion, the traffic light can be mounted efficiently while at the same time providing for a traffic light housing, that will breakaway upon being struck, without damaging the mounting pole.

In FIG. 1, the mounting cap 100 is shown as it is used in a traffic light assembly 120. The traffic light assembly 120 includes a mounting pole 122. The breakaway cap 100 is mounted on the top of mounting pole 122. A first upper arm 124 is secured to the breakaway cap 100. A lower, second arm 126 is mounted to the pole 122.

In each of first arm 124 and second arm 126 is mounted a wire cap 128. Traffic light housing 130 is received and supported in traffic light assembly 120 by the two, oppositely disposed wire caps 128.

Traffic light housing 130 may have one, two, three or more lens assemblies. Traffic light housing 130 may be mounted vertically or horizontally or variations thereof and have cap 100 adapted thereto. Usually the mounting is along the vertical axis of traffic light housing 130.

The breakaway cap 100, in receiving the upper first arm 124 at mounting flange 146, supports traffic light housing 130 at mating arm aperture 160, below described within traffic light assembly 120. The lower second arm 126 is strap secured to mounting pole 122 and completes the support for traffic light housing 130. Breakaway cap 100 permits the separation of the traffic light housing 130 from the mounting pole 122 in the event that the traffic light housing 130 is struck by a vehicle, such as a heavy duty truck (not shown). With this breakaway, no or minimal damage is done to the mounting pole 122. The traffic light housing 130 then becomes easier to re-install.

Figure 2:
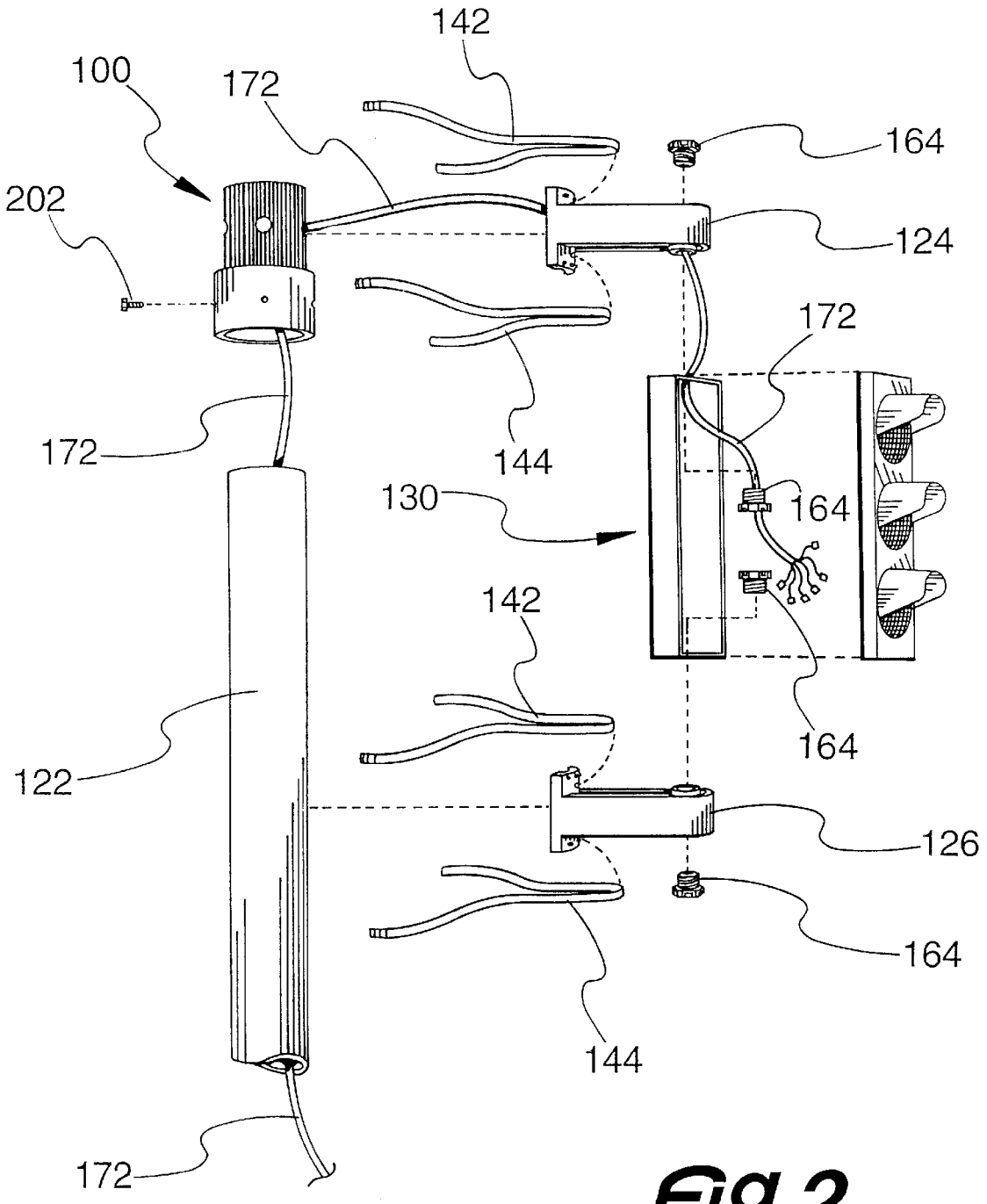
FIG. 2 depicts an exploded, perspective view of FIG. 1.
Figure 3:
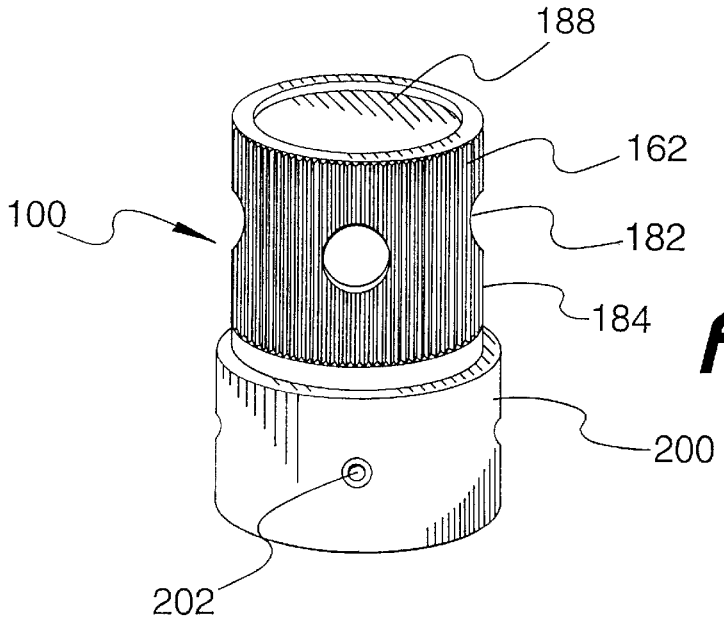
FIG. 3 depicts a top, perspective view of mounting cap 100.
Figure 4:
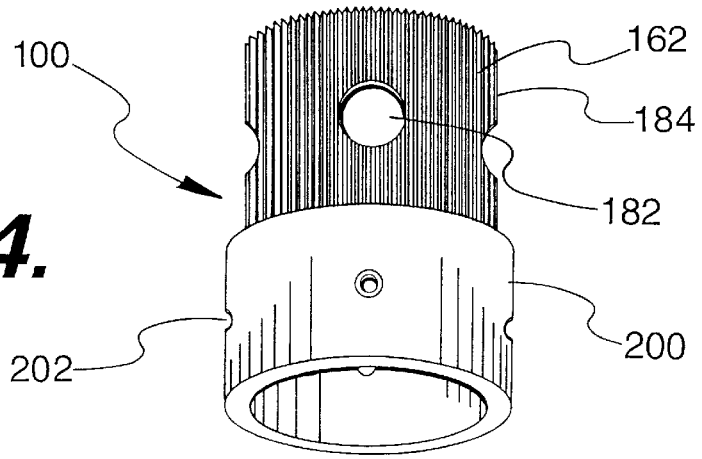
FIG. 4 depicts a bottom, perspective view of mounting cap 100.
Figure 5:
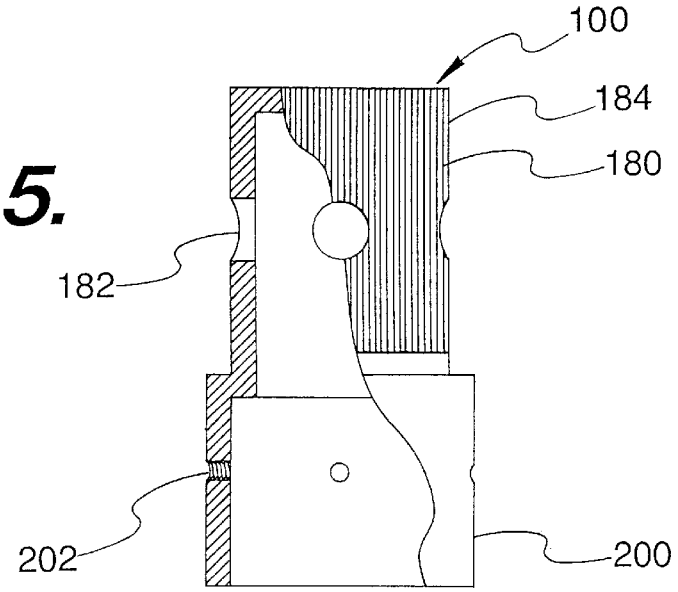
FIG. 5 depicts a side, cross-sectioned view of mounting cap 100.
Figure 6:
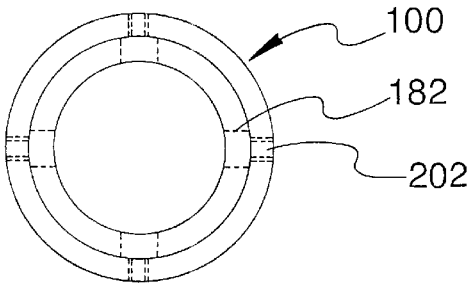
FIG. 6 depicts a bottom, plan view of mounting cap 100.
Figure 7:
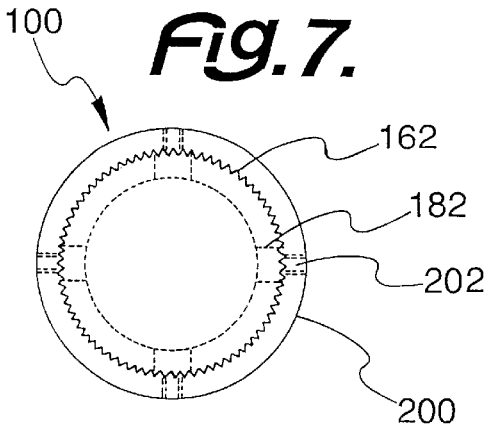
FIG. 7 depicts a top, plan view of mounting cap 100.

Adding FIG. 2 to the consideration, on the mounting pole 122, a strap assembly 140 secures the upper or first arm 124 to the mounting cap 130 and the lower or second arm 126 to the mounting pole 122. Preferably in the strap assembly 140, there is an upper mounting strap 142 and a lower mounting strap 144 for each of the first arm 124 and the second arm 126.

The upper or first arm 124 and the lower or second arm 126 each have a mounting flange 146 with an upper protrusion 148 and a lower protrusion 150 extending therefrom. The lower protrusion 150 is received in the lower strap 144, as lower strap 144 is wrapped around the mounting pole 122 or breakaway cap 100 as desired. The upper protrusion 144 is received in the upper strap 142, as upper strap 142 is wrapped around the mounting pole 122.

From the mounting flange 146 of first arm 124 or second arm 126 extends housing receiver 154. Housing receiver 154 includes a mating arm aperture 160 for receiving the traffic light housing 130, which is, oppositely disposed from flange 146. First arm 124 and second arm 126 combine with mounting cap 100 to permit light housing 130 to breakaway when struck, without damaging mounting pole 122.

Adding FIG. 3, FIG. 4, FIG. 5, FIG. 6 and FIG. 7 to the consideration more clearly describes mounting cap 100. With the breakaway cap 100 received by the arm aperture 160 at an lower cylinder 200 thereof. Upper cylinder 180 of cap 100 receives upper arm 124, while the lower cylinder 200 of the breakaway cap 100 receives the mounting pole 122.

Lower cylinder 200 can be secured to the mounting pole 122 in any suitable fashion. An effective device to fasten breakaway cylinder 100 to mounting pole 122 is lock bolt 202, which cuts or fits through necessary apertures therefor.

As above stated, an appropriate wire bushing 170 secures the traffic light housing 130 into either upper arm 124 or lower arm 126. A power command cord 172 can than be received by the light housing 130 with minimal problem through wire bushing 170, if desired. Wire bushing 170 is replaced by a plug 174 if no wire is needed.

If the traffic light housing 130 is ever struck, for example by a vehicle, no damage is done to the mounting post 122 of the traffic light assembly 120, because the cap 100 permits the traffic light housing 130 to breakaway from the post. When this break occurs, it happens without severe damage to the mounting pole or post 122 and with minimal damage to the arms 124 and 126. All that has to be replaced is the cap 100 and possibly arms 124 and 126.

The cap 100 includes a larger cylindrical section in the form of lower cylinder 200 and a smaller cylindrical section in the form of upper cylinder 180, as determined by the diameter. Lower cylinder 200 fits over the top of mounting post 122.

The smaller upper cylinder 180 has upper apertures 182 (preferably four in number) radially spaced thereabout and in the same plane. On the outer wall 184 of the upper cylinder 180 are optionally serrations 186 surrounding the outer wall 184. Serrations 186 support the mounting of upper arm 124, which in turn provides upper support for traffic light housing 136. Serration 186 strengthen the position of upper arm 122, while providing for adjustment thereof.

Upper cylinder 180 is preferably closed by top wall 188. Top wall 188 is oppositely disposed from lower cylinder 200. This preference results from top wall 188 adding strength to the breakaway cap 100.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A traffic light assembly including a mounting pole, a traffic light housing secured to the mounting pole, and a first arm and a second arm providing at least a first part of a securing means for mounting the traffic light housing to the mounting pole, the traffic light assembly including an improvement comprising:

(a) a breakaway cap providing a second part of the securing means;

(b) the breakaway cap including a larger cylindrical section and a smaller cylindrical section;

(c) the smaller cylindrical section being an upper cylinder;

(d) the larger cylindrical section being a lower cylinder;

(e) the smaller cylindrical section being adapted to receive the first arm;

(f) the larger cylindrical section being adapted to receive the mounting pole;

(g) the smaller cylindrical section having ridges thereon; and (h) the ridges serving to support the first arm.

2. The traffic light assembly of claim 1 having the improvement further comprising:

(a) the smaller cylindrical section having at least one aperture therein; and (b) the smaller cylindrical section adjacent to a top of the mounting post.

3. The traffic light assembly of claim 2 having the improvement further comprising:

(a) the larger cylindrical section being receivable on a top of the mounting pole;

(b) and the larger cylindrical section including at least two lower base apertures in order to secure the breakaway cap to the mounting pole.

4. The traffic light assembly of claim 3 having the improvement further comprising:

(a) the smaller cylindrical section with the at least one aperture being four upper apertures, each upper aperture having a coplanar center therein; and (b) the coplanar center of each upper aperture being spaced from an adjoining upper aperture.

5. The traffic light assembly of claim 4 having the improvement further comprising:

(a) the larger cylindrical section with at least two lower base apertures having four lower apertures; and (b) each lower aperture having a coplanar center therein.

6. The traffic light assembly of claim 5 having the improvement further comprising the breakaway cap being formed of a high impact plastic.

7. The traffic light assembly of claim 6 having the improvement further comprising the high impact plastic being at least one selected from the group consisting of polycarbonate, polyethylene, and polypropylene.

8. A traffic light assembly having a breakaway structure comprising:

(a) the traffic light assembly including a mounting pole, a traffic light housing secured to the mounting pole, and a first arm and a second arm providing at least a first part of a securing means for mounting the traffic light housing to the mounting pole;

(b) a strap assembly forming at least a second part of the securing means and serving to secure the first arm and the second arm to the mounting pole;

(c) a breakaway cap providing a second part of the securing means and securing the traffic light housing to the first arm;

(d) the breakaway cap including a larger cylindrical section and a smaller cylindrical section;

(e) the smaller cylindrical section being an upper cylinder;

(f) the larger cylindrical section being a lower cylinder;

(g) the smaller cylindrical section being adapted to receive the first arm;

(h) the larger cylindrical section being adapted to receive the mounting pole;

(i) the smaller cylindrical section having ridges thereon;

(j) the ridges serving to support the first arm;

(k) the smaller cylindrical section having at least one aperture therein;

(l) the breakaway cap being formed of a high impact plastic; and (m) the high impact plastic being at least one selected from the group consisting of polycarbonate, polyethylene, polypropylene, and copolymers thereof.

9. The traffic light assembly of claim 8 having the improvement further comprising:

(a) the larger cylindrical section being receivable on a top of the mounting post;

(b) the larger cylindrical section including at least two lower base apertures in order to secure the breakaway cap to the mounting pole;

(c) the smaller cylindrical section with at least one aperture having four upper apertures, each upper aperture having a coplanar center therein;

(d) the larger cylindrical section with at least two lower base apertures having four lower apertures, each lower aperture having a coplanar center therein; and (e) the breakaway cap being duplicated in the traffic light assembly and providing an additional member of the second part of the securing means and securing the traffic light housing to the second arm.

* * * * *